US007048202B2

(12) United States Patent
Bierstaker et al.

(10) Patent No.: US 7,048,202 B2
(45) Date of Patent: May 23, 2006

(54) COMPOUND-ANGLED ORIFICES IN FUEL INJECTION METERING DISC

(75) Inventors: John Edward Bierstaker, Grafton, VA (US); John S. Bright, Hanover, PA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 0 days.

(21) Appl. No.: 10/793,117

(22) Filed: Mar. 4, 2004

(65) Prior Publication Data

US 2005/0194458 A1 Sep. 8, 2005

(51) Int. Cl.
*F02D 1/06* (2006.01)

(52) U.S. Cl. ..... 239/5; 239/494; 239/497; 239/533.12; 239/552; 239/585.1; 239/596; 239/900

(58) Field of Classification Search ..... 239/5, 239/491, 494, 497, 533.12, 552, 584, 585.1, 239/585.4, 585.5, 596, 900; 29/890.132, 29/890.142, 890.143
See application file for complete search history.

(56) References Cited

U.S. PATENT DOCUMENTS 5,484,108 A * 1/1996 Nally ..... 239/585.4
5,489,065 A * 2/1996 Nally, Jr. ..... 239/552
5,746,376 A * 5/1998 Romann et al. ..... 239/585.4
6,330,981 B1 * 12/2001 Nally et al. ..... 239/596

* cited by examiner

*Primary Examiner*—Steven J. Ganey

(57) ABSTRACT

A valve subassembly of a fuel injector that allows spray targeting and distribution of fuel to be configured using non-angled or straight orifice having an axis parallel to a longitudinal axis of the subassembly. Metering orifices are located about the longitudinal axis and defining a first virtual circle greater than a second virtual circle defined by a projection of the sealing surface onto the metering disc so that all of the metering orifices are disposed outside the second virtual circle. The projection of the sealing surface converges at a virtual apex disposed within the metering disc. At least one channel extends between a first end and second end. The first end is disposed at a first radius from the longitudinal axis and spaced at a first distance from the metering disc. The second end is disposed at a second radius with respect to the longitudinal axis and spaced at a second distance from the metering disc such that a product of the first radius and the first distance is approximately equal to a product of the second radius and the second distance. Methods of controlling spray distribution and targeting are also provided.

21 Claims, 5 Drawing Sheets

COMPOUND-ANGLED ORIFICES IN FUEL INJECTION METERING DISC

BACKGROUND OF THE INVENTION

Most modern automotive fuel systems utilize fuel injectors to provide precise metering of fuel for introduction into each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The metering and atomization of the fuel reduces combustion emissions and increases the fuel efficiency of the engine. Thus, as a general rule, the greater the precision in metering and targeting of the fuel and the greater the atomization of the fuel, the lower the emissions with greater fuel efficiency.

An electromagnetic fuel injector typically utilizes a solenoid assembly to supply an actuating force to a fuel metering assembly. Typically, the fuel metering assembly includes a seat and closure member, which reciprocates between a closed position, where the closure member is seated in a seat to prevent fuel from escaping through a metering orifice into the combustion chamber, and an open position, where the closure member is lifted from the seat, allowing fuel to discharge through the metering orifice for introduction into the combustion chamber.

The fuel injector is typically mounted upstream of the intake valve in the intake manifold or proximate a cylinder head. As the intake valve opens on an intake port of the cylinder, fuel is sprayed towards the intake port. In one situation, it may be desirable to target the fuel spray at the intake valve head or stem while in another situation, it may be desirable to target the fuel spray at the intake port instead of at the intake valve. In both situations, the targeting of the fuel spray can be affected by the spray or cone pattern. Where the cone pattern has a large divergent cone shape, the fuel sprayed may impact on a surface of the intake port rather than towards its intended target. Conversely, where the cone pattern has a narrow divergence, the fuel may not atomize and may even recombine into a liquid stream. In either case, incomplete combustion may result, leading to an increase in undesirable exhaust emissions.

Complicating the requirements for targeting and spray pattern is cylinder head configuration, intake geometry and intake port specific to each engine's design. As a result, a fuel injector designed for a specified cone pattern and targeting of the fuel spray may work extremely well in one type of engine configuration but may present emissions and driveability issues upon installation in a different type of engine configuration. Additionally, as more and more vehicles are produced using various configurations of engines (for example: inline-4, inline-6, V-6, V-8, V-12, W-8 etc.,), emission standards have become stricter, leading to tighter metering, spray targeting and spray or cone pattern requirements of the fuel injector for each engine configuration.

It is believed that one approach to meeting emission standards in a fuel injector is to minimize the so-called "sac volume." As it is used in this disclosure, sac volume is defined as a volume downstream of a closure member/seat sealing perimeter and upstream of the orifice hole(s), which can be also viewed as the volume of fuel remaining in the interior of the tip of the injector. This volume of fuel is believed to affect combustion and unwanted emission at the end of a fuel injection cycle, and therefore, it is believed that such sac volume should be minimized.

It is also believed that a metering disc can be deformed to provide a dimpled surface. Such dimpled surface is believed to allow a metering orifice to be oriented relative to a referential datum by a single included angle. However, by orientating the metering orifice with a single included angle, such metering disc apparently fails to permit targeting of the fuel spray consonant with the metering, spray targeting and spray or cone pattern requirements particular to each type of engines. Moreover, such metering disc, when used in a fuel injector, may cause the fuel injector to have a large sac volume that could affect combustion and unwanted emission in the engine in which such injector is utilized therein.

SUMMARY OF THE INVENTION

The present invention provides fuel targeting and fuel spray distribution with non-angled metering orifices in a metering disc that can be deformed to provide a metering orifice oriented with respect to two referential datum planes. In a preferred embodiment, a fuel injector is provided. The fuel injector comprises a seat, movable closure member, and a metering disc. The seat includes a passage extending along a longitudinal axis between an inlet and outlet. The movable member cooperates with the seat to permit and prevent a flow of fuel through the passage. The metering disc includes peripheral, central and intermediate portions. The peripheral portion extends generally parallel to a base plane, and the base plane being generally orthogonal with respect to the longitudinal axis. The intermediate portion is disposed radially with respect to the longitudinal axis between the peripheral and central portions. The intermediate portion includes a plurality of surfaces intersecting with the base plane and a plurality of metering orifices disposed on respective plurality of surfaces. The metering orifices penetrating the intermediate portion, and each of the plurality of orifices extends along a respective orifice axis at a first angle relative to a radial axis from the longitudinal axis through the metering orifice axis, and at a second angle relative to the longitudinal axis.

In yet another embodiment, a method of controlling a spray angle of fuel flow through at least one metering orifice of a fuel injector is provided. The fuel injector has an inlet and an outlet and a passage extending along a longitudinal axis therethrough. The outlet has a seat and a metering disc. The metering disc includes peripheral, central, and intermediate portions. The peripheral portion extends generally parallel to a base plane, and the base plane being generally orthogonal with respect to the longitudinal axis. The intermediate portion is disposed radially with respect to the longitudinal axis between the peripheral and central portions. The method can be achieved by locating a plurality of metering orifices about the longitudinal axis such that the metering orifices extend generally parallel to the longitudinal axis through the metering disc to define respective generally parallel metering axes; and deforming at least one of the intermediate and central portions of the metering disc so that each of the metering axes extend along a respective orifice axis at a first angle relative to a radial axis from the longitudinal axis through the metering orifice axis, and at a second angle relative to the longitudinal axis.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
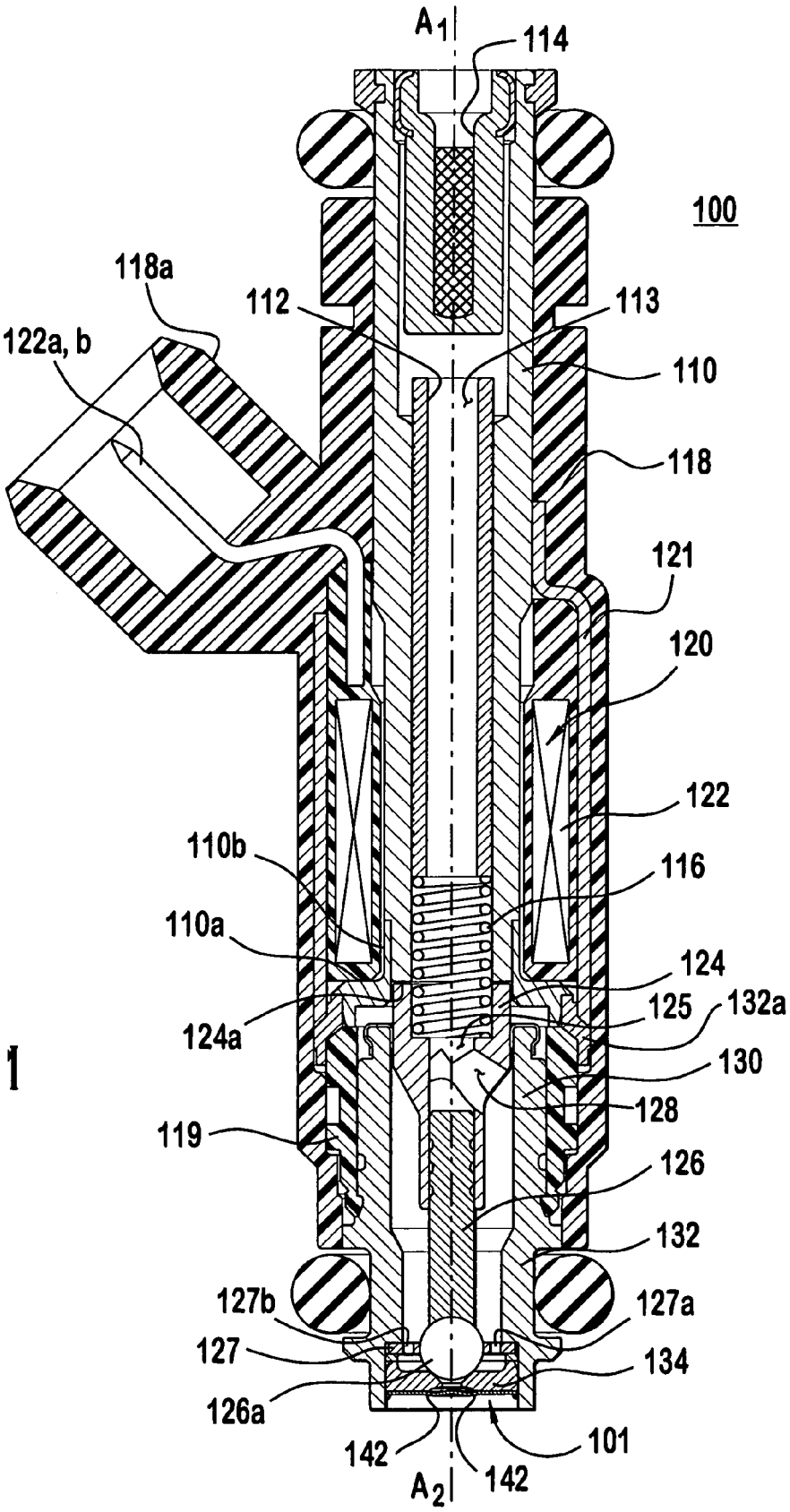
FIG. 1 illustrates a preferred embodiment of the fuel injector.

FIGS. 1–4 illustrate the preferred embodiments. In particular, a fuel injector 100 having a preferred embodiment of the metering disc 10 is illustrated in FIG. 1. The fuel injector 100 includes: a fuel inlet tube 110; an adjustment tube 112; a filter assembly 114; a coil assembly 120; a coil spring 116; an armature 124; a closure member 126; a non-magnetic shell 110*a*; a first overmold 118; a valve body 132; a valve body shell 132*a*; a second overmold 119; a coil assembly housing 121; a guide member 127 for the closure member 126; a seat 134; and a metering disc 10.

The guide member 127, seat 134, and metering disc 10 form a stacked assembly that is coupled at the outlet end of fuel injector 100 by a suitable coupling technique, such as, for example, crimping, welding, bonding or riveting. Armature 124 and the closure member 126 are coupled together to form an closure assembly 126 assembly. It should be noted that one skilled in the art could form the assembly from a single component instead of a plurality of components.

Coil assembly 120 includes a plastic bobbin on which an electromagnetic coil 122 is wound. Respective terminations of coil 122 connect to respective terminals 122*a*, 122*b* that are shaped and, in cooperation with a connector portion 118*a* formed as an integral part of overmold 118, to form an electrical connector for connecting the fuel injector 100 to an electronic control unit (not shown) that operates the fuel injector.

Fuel inlet tube 110 can be ferromagnetic and includes a fuel inlet opening at the exposed upper end. Filter assembly 114 can be fitted proximate to the open upper end of adjustment tube 112 to filter any particulate material larger than a certain size from fuel entering through inlet opening before the fuel enters adjustment tube 112.

In the calibrated fuel injector, adjustment tube 112 has been positioned axially to an axial location within fuel inlet tube 110 that compresses preload spring 116 to a desired bias force that urges the closure assembly 126 such that the rounded tip end of closure member 126 can be seated on seat 134 to close the central hole through the seat. Preferably, tubes 110 and 112 are crimped together to maintain their relative axial positioning after adjustment calibration has been performed.

After passing through adjustment tube 112, fuel enters a volume that is cooperatively defined by confronting ends of inlet tube 110 and armature 124 and that contains preload or bias spring 116. Armature 124 includes a passageway 128 that communicates volume 125 with a passageway 113 in valve body 130, and guide member 127 contains fuel passage holes 127*a*, 127*b*. This allows fuel to flow from volume 125 through passageways 113, 128 to seat 134.

Non-ferromagnetic shell 110*a* can be telescopically fitted on and joined to the lower end of inlet tube 110, as by a hermetic laser weld. Shell 110*a* has a tubular neck that telescopes over a tubular neck at the lower end of fuel inlet tube 110. Shell 110*a* also has a shoulder that extends radially outwardly from neck. Valve body shell 132*a* can be ferromagnetic and can be joined in fluid-tight manner to non-ferromagnetic shell 110*a*, preferably also by a hermetic laser weld.

The upper end of valve body 130 fits closely inside the lower end of valve body shell 132*a* and these two parts are joined together in fluid-tight manner, preferably by laser welding. Armature 124 can be guided by the inside wall of valve body 130 for axial reciprocation. Further axial guidance of the closure assembly 126 assembly can be provided by a central guide hole in member 127 through which closure member 126 passes. The construction of fuel injector 100 can be of a type similar to those disclosed in commonly assigned U.S. Pat. Nos. 4,854,024; 5,174,505; and 6,520,421 with respect to details that are not specifically portrayed in FIG. 1, and which are incorporated by reference in their entirety into this application.

Figure 2A:
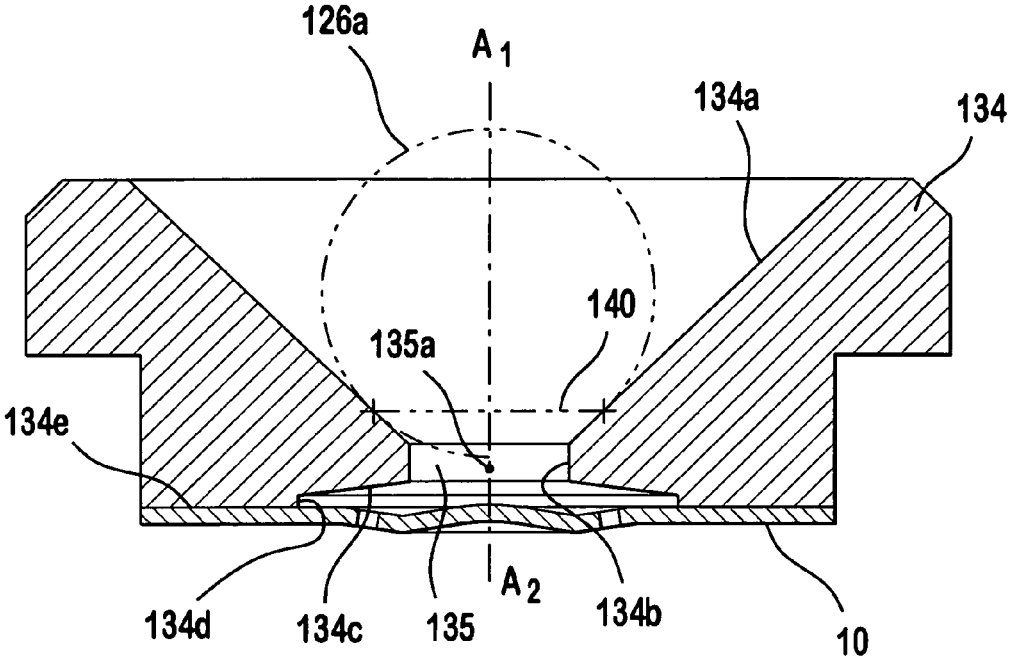
FIG. 2A illustrates a close-up cross-sectional view of an outlet end of the fuel injector of FIG. 1.

Referring to a close up illustration of the seat subassembly of the fuel injector in FIG. 2A which has a closure member 126, seat 134, and a metering disc 10. The closure member 126 includes a spherical member 126*a* disposed at one end distal to the armature. The spherical member 126*a* engages the seat 134 on seat surface 134*a* so as to form a generally line contact seal between the two members. The seat surface 134*a* tapers radially downward and inward toward the seat orifice 135 such that the surface 134*a* is oblique to the longitudinal axis A1–A2. As used herein, the words "inward" and "outward" refer to directions toward and away from, respectively, the longitudinal axis A1–A2. The line contact seal can be defined as a sealing circle 140 formed by contiguous engagement of the spherical member 126*a* with the seat surface 134*a*, shown herein FIG. 2A. The seat 134 includes a seat orifice 135, which extends generally along the longitudinal axis A1–A2 of the housing 20 and is formed by a generally cylindrical wall 134*b*. Preferably, a center 135*a* of the seat orifice 135 is located generally coincident on the longitudinal axis A1–A2.

Downstream of the circular wall 134*b*, the seat 134 tapers along a portion 134*c* obliquely towards a bottom surface 134*e*. The taper of the portion 134*c* preferably can be linear or curvilinear with respect to the longitudinal axis A1–A2, such as, for example, a curvilinear taper that forms an interior dome. In one preferred embodiment, the taper of the portion 134*c* is linearly tapered (FIG. 2A) downward and outward at a predetermined taper angle, and thereafter extends along and generally parallel to the longitudinal axis so as to preferably form cylindrical wall surface 134*d*. The wall surface 134*d* extends downward and subsequently extends in a generally radial direction to form the bottom surface 134*e*, which is preferably perpendicular to the longitudinal axis A1–A2.

A central interior face 44 of the metering disc 10 is provided in a facing arrangement with the orifice 135. The metering disc 10 includes a first surface 10*a* facing towards the inlet of the fuel injector 100 and a second surface 10*b* spaced from the first surface 10*a*. The first surface 10*a* is preferably contiguous to the bottom surface 134*e* of the seat 134.

Figure 2C:
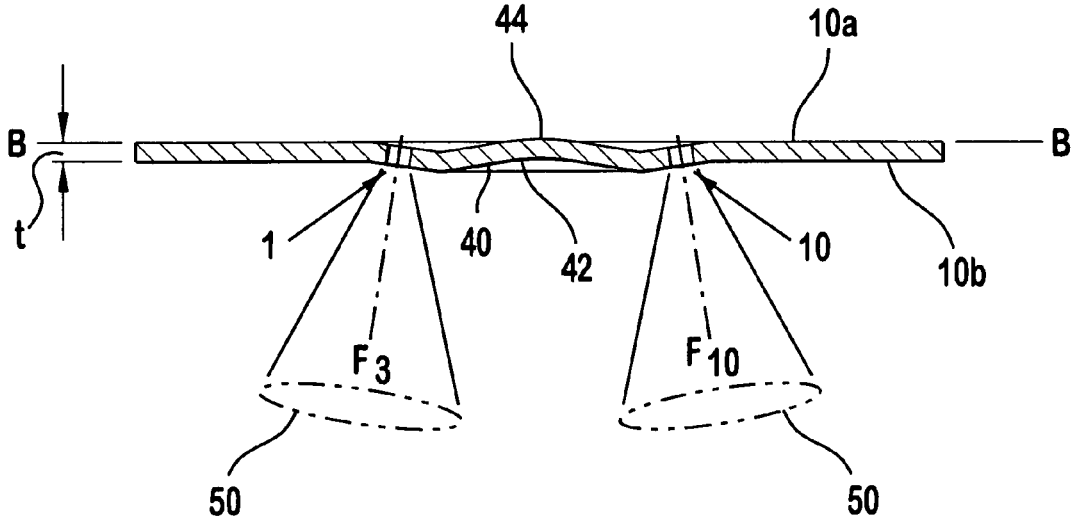
FIG. 2C illustrates an enlarged cross-sectional view of the metering disc of FIG. 2B
Figure 2B:
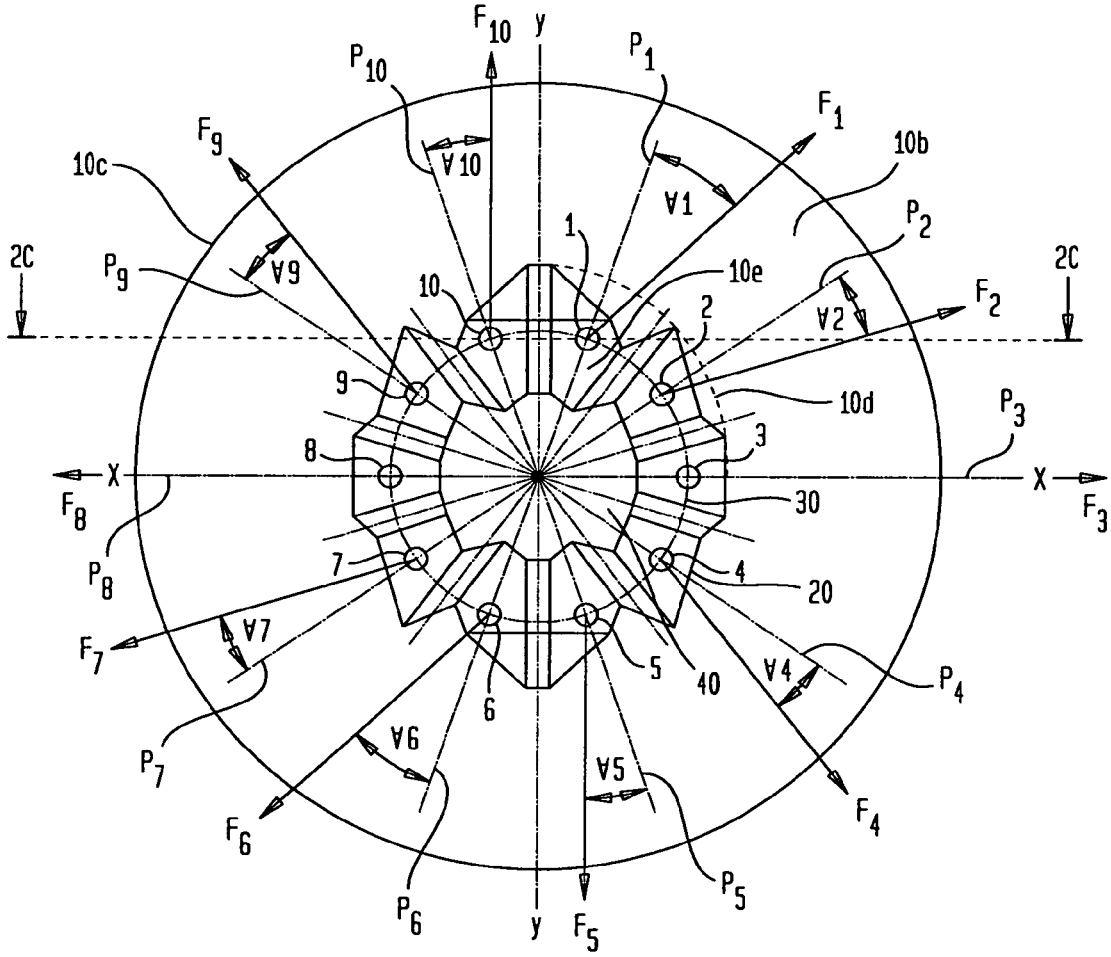
FIG. 2B illustrates a plan view of the metering disc of FIG. 2A denoting respective axes of each metering orifice as referenced to a radial axis passing through a longitudinal axis A1–A2 and intersecting with the metering orifice axis so that each axis of the metering orifices can be located, in part, by a first angle on the dimpled surface.

Viewing the surface 10*b* in the plan view of FIG. 2B, it can be seen that the disc 10 has a generally planar peripheral portion 10*c* surrounding an intermediate portion 10*d*. The intermediate portion 10*d* thereafter surrounds a central portion 10*e*. The intermediate and central portions can include dimpled surfaces (indicated generally as surfaces 20) of the metering disc 10 with metering orifices located on the dimpled surfaces. In particular, the dimpled surfaces 20 of the metering disc 10 can be obtained by a suitable material deforming technique on a generally planar workpiece such as for example, faceted, ball or cylindrical dimpling of the generally flat workpiece. As used herein, the term "dimpling" indicates a permanent material deformation, preferably by deforming the material until the plastic yield point of the material is reached so that the dimpled surfaces intersect a virtual extension of the planar surfaces of the work piece. For example, the central portion 10*e* can be dimpled with a curved tool so that the surface of the workpiece can be plastically deformed or permanently elongated into a dimpled central portion 40 and the intermediate portion 10*d* can be dimpled with a planar dimpling tool to provide for one or more of curved, planar or compound dimples.

Preferably, the dimpled central portion 40 includes a curved or radiused dimple 42 (FIG. 2C). The curved dimple 42 has an apex 44 extending towards the inlet end of the fuel injector 100. The dimpled central portion or depression 40 in the surface of the work piece (i.e., non-planar dimple) can be provided proximate the center of the work piece to provide for a minimal sac volume in the fuel injector 100. In particular, the surface 10*b* (i.e. the fuel outlet side) can be dimpled towards the upstream direction with a suitable tool that preferably forms a radiused portion 42. The radiused portion 42 can form a volume that intersects a referential datum plane B—B so as to define the sac volume of the fuel injector. That is to say, the volume can project toward the seat orifice 135 to provide the interior volume between the closure member 126*a* and the metering disc 10, which interior volume provides the minimal space required for the fuel injector to operate and provides as small a sac volume as possible. Preferably, the radiused portion 42 is contiguous to the referential datum plane B—B.

In the preferred embodiment of FIG. 2B, the dimpled surface can be formed either before or after the forming metering orifices on the generally flat work pieces. Preferably, ten metering orifices, denoted here as 1, 2, 3, 4, 5, 6, 7, 8, 9, and 10, are formed so that the metering orifices are located on a circle 30 with the respective orifice axes extending generally parallel to the longitudinal axis A1–A2. Thereafter, the generally flat work pieces can be dimpled to provide generally at least two planar facets (e.g., facetted dimples) oriented oblique to the generally planar surface of the peripheral portion 10*c* of the disc 10. Preferably, the intermediate portion 10*d* is dimpled with a suitable tool so that planar facets A–K are provided on the generally planar disc 10 subsequent to the formation of metering orifices 1–10. Also, each of the plurality of metering orifices has a diameter ranging from approximately 100 microns to approximately 600 microns, and preferably from 125 microns to 400 microns.

Figure 3:
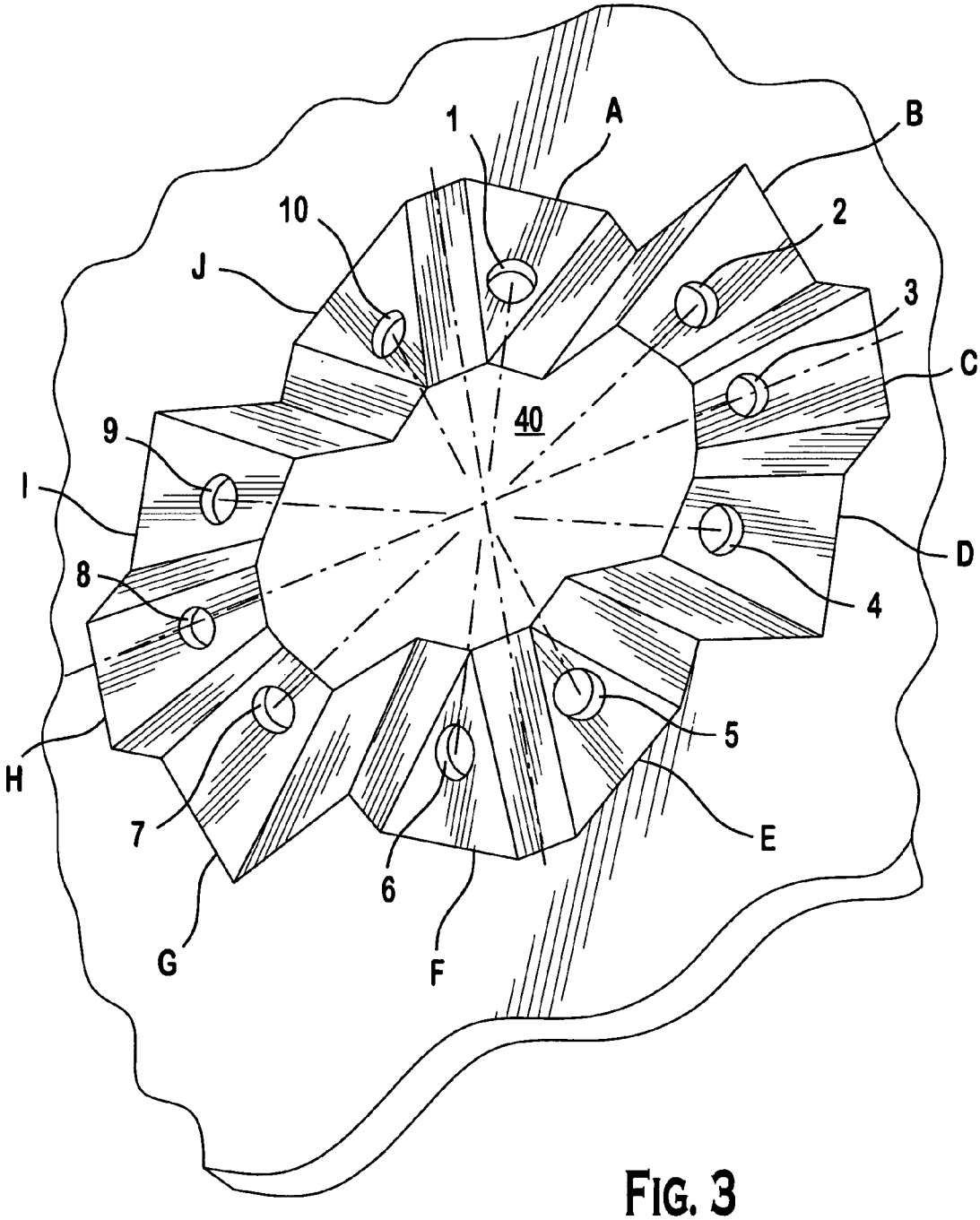
FIG. 3 illustrates a perspective view of the dimpled portion of the metering disc of FIG. 2B.

Referring to FIG. 3, each of the metering orifices 1–10 is preferably located on respective planar facets of the dimpled surfaces A–K. As shown in FIG. 2B, at least two of the metering orifices are located on the facets such that a centerline extending through the metering orifice is oriented at a first angle $\forall_n$ (i.e., alpha-sub-n where the subscript "n" denotes orifice number in FIG. 2B) with respect to a plane $P_n$ passing through the longitudinal axis and the respective centerline of the orifice, i.e., orifice axis Fn. For example, a plane $P_1$ extends through longitudinal axis A1–A2 and orifice axis $F_1$ so that the orifice axis $F_1$ is oriented at angle $\forall_1$. In another example, the orifice axis $F_3$ is coplanar with the plane P3 such that the angle $\forall_3$ for orifice 3 is about zero. In the preferred embodiment, at least two of the metering orifices are oriented at a first angle with respect to a plane passing through both metering orifices and the longitudinal axis and generally parallel to the longitudinal axis.

Figure 4:
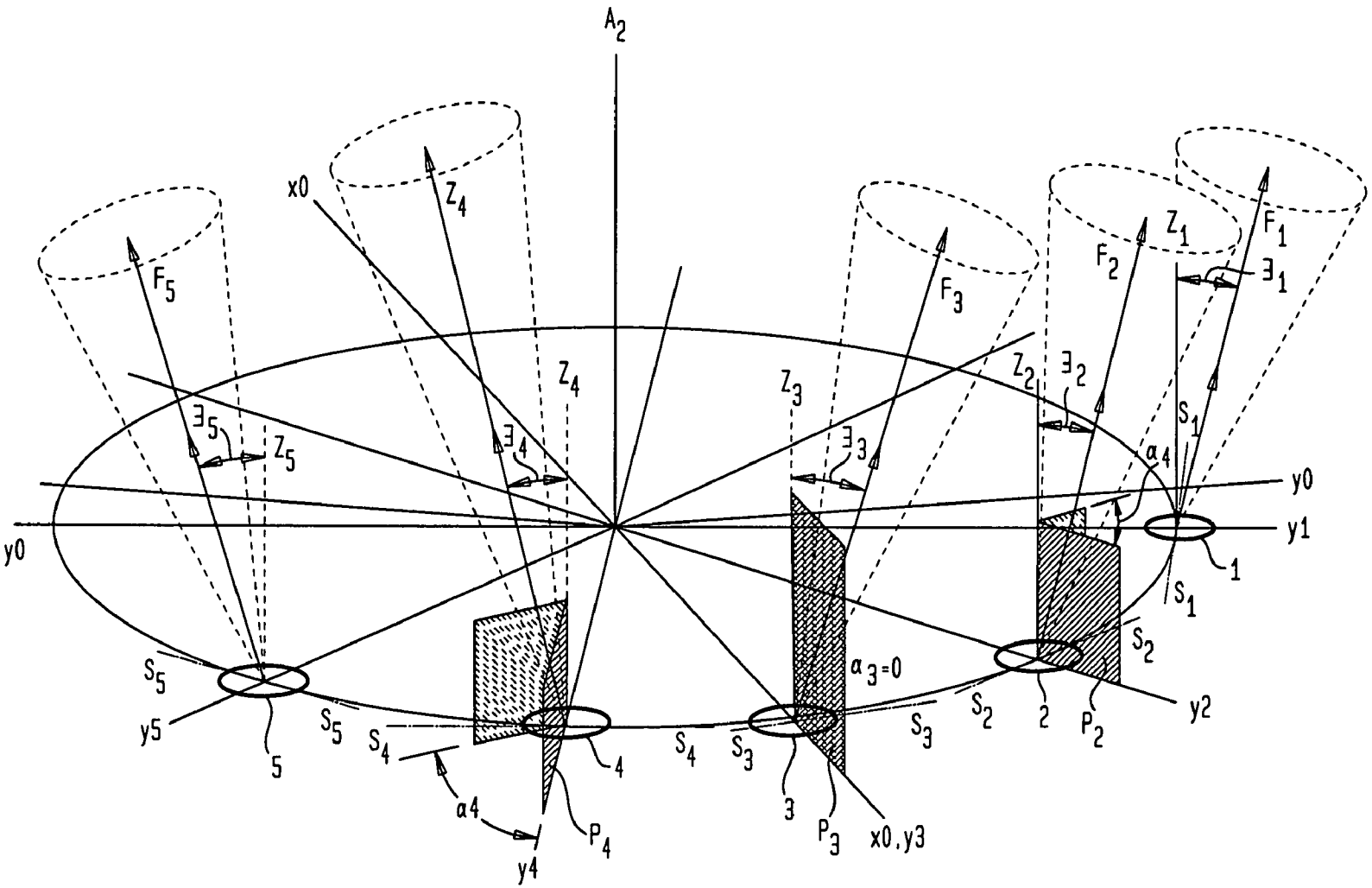
FIG. 4 illustrates a relationship of respective axes of each metering orifice as referenced to a longitudinal axis of the metering disc so that each metering orifice can be located, in part, by a second angle on the dimpled surface of the disc.

Furthermore, each of the metering orifices 1–10 can be oriented at a second angle $\exists_n$ with respect to a longitudinal axis $Z_n$ generally parallel to the longitudinal axis A1–A2 as shown in FIG. 4. For example, the orifice F1 extends at an angle $\exists_n$ relative to longitudinal axis $Z_1$ in FIG. 4. Similarly, each of the orifices n (where n=a suitable number of orifices) extends at a second angle $\exists_n$ relative to the respective longitudinal axes $Z_n$. Thus, the orientation of each orifice n (i.e., orifice axis $F_n$) can be located by two referential datum: (1) a plane parallel to and passing through the longitudinal axis and the orifice axis to define a first angle $\forall_n$, and (2) a longitudinal axis generally parallel to the longitudinal axis to define the second angle $\exists_n$ as provided in Table I below.

TABLE I

| Orientation of Orifices | | |
|---|---|---|
| Orifice | $\forall_n$ (degrees) | $\exists_n$ (degrees) |
| 1 | 2 | 8 |
| 2 | 2 | 10 |
| 3 | 0 | 9 |
| 4 | 2 | 10 |
| 5 | 2 | 9 |
| 6 | 2 | 8 |
| 7 | 2 | 10 |
| 8 | 0 | 9 |
| 9 | 2 | 10 |
| 10 | 2 | 8 |

The surface 10*a* and surface 10*b* can be performed simultaneously or one surface can be deformed during a time interval that may overlap a time interval of the deformation of the other surface. Alternatively, the first surface 10*a* can be deformed before the second surface 10*b* is deformed. In a preferred embodiment, the surface 10*a* is deformed at a time interval that substantially overlaps the time interval of the deformation of the second surface 10*b*.

In operation, the fuel injector 100 is initially at the non-injecting position shown in FIG. 1. In this position, a working axial gap exists between the annular end face 110*b* of fuel inlet tube 110 and the confronting annular end face 124*a* of armature 124. Coil housing 121 and tube 12 are in contact at 74 and constitute a stator structure that is associated with coil assembly 120. Non-ferromagnetic shell 110*a* assures that when electromagnetic coil 122 is energized, the magnetic flux will follow a path that includes armature 124. Starting at the lower axial end of housing 34, where it is joined with value body shell 132*a* by a hermetic laser weld, the magnetic circuit extends through valve body shell 132*a*, valve body 130 and eyelet to armature 124, and from armature 124 across working gap to inlet tube 110, and back to housing 121.

When electromagnetic coil 122 is energized, the spring force on armature 124 can be overcome and the armature is attracted toward inlet tube 110 reducing working axial gap. This unseats closure member 126 from seat 134 to open the fuel injector so that pressurized fuel in the valve body 132 flows through the seat orifice and through orifices formed on the metering disc 10. When the coil 122 ceases to be energized, preload spring 116 pushes or biases the closure member 126 against the seat 134 to prevent fuel flow to the orifice 135.

As described, the preferred embodiments, including the techniques of controlling spray angle targeting and distribution are not limited to the fuel injector described but can be used in conjunction with other fuel injectors such as, for example, the fuel injectors set forth in U.S. Pat. No. 5,494,225 issued on Feb. 27, 1996, or the modular fuel injectors set forth in U.S. patent application Ser. No. 09/828,487 filed on 9 Apr. 2001, which is pending, and wherein both of these documents are hereby incorporated by reference in their entireties herein.

While the present invention has been disclosed with reference to certain embodiments, numerous modifications, alterations and changes to the described embodiments are possible without departing from the: sphere and scope of the present invention, as defined in the appended claims. Accordingly, it is intended that the present invention not be limited to the described embodiments, but that it has the full scope defined by the language of the following claims, and equivalents thereof.

What we claim is:

1. A fuel injector for spray targeting fuel, the fuel injector comprising:

a seat including a passage extending along a longitudinal axis between an inlet and outlet;

a movable closure member cooperating with the seat to permit and prevent a flow of fuel through the passage; and a metering disc including:

a peripheral portion extending generally radially to the longitudinal axis on a base plane;

a central portion extending generally radially with respect to the longitudinal axis; and an intermediate portion disposed radially with respect to the longitudinal axis between the peripheral and central portions, the intermediate portion including:

a plurality of surfaces intersecting the base plane; and a plurality of metering orifices disposed on the plurality of surfaces, to orifice penetrating the intermediate portion, each of the plurality of metering orifices extending along a respective orifice axis at a first angle relative to a radial axis from the longitudinal axis through the metering orifice axis, and at a second angle relative to the longitudinal axis.

2. The fuel injector of claim 1, wherein the first angle comprises an angle from about zero to about 5 degrees.

3. The fuel injector of claim 2, wherein the second angle comprises an angle from about 5 degrees to about 10 degrees.

4. The fuel injector of claim 3, wherein the plurality of metering orifices comprises at least two metering orifices diametrically disposed on a virtual perimeter extending through the respective orifice axes.

5. The fuel injector of claim 4, wherein the respective axes of the at least two metering orifices are symmetrical about the longitudinal axis and the radial axis.

6. The fuel injector of claim 5, wherein the plurality of metering orifices comprises at least four metering orifices disposed equiangularly on the virtual perimeter.

7. The fuel injector of claim 6, wherein each of the plurality of metering orifices has a diameter ranging from approximately 100 microns to approximately 600 microns.

8. The fuel injector of claim 6, wherein each of the plurality of metering orifices has a diameter less than about 400 microns.

9. The fuel injector of claim 5, wherein the central portion comprises a curved surface having a radiused apex projecting towards the inlet.

10. The fuel injector of claim 7, wherein the intermediate portion comprises at least one planar surfaces intersecting the central portion to define a respective apex projecting towards the outlet.

11. The fuel injector of claim 10, wherein the radiused apex comprises a surface contiguous to the base plane.

12. The fuel injector of claim 11, wherein the metering disc comprises a stainless steel disc having a thickness proximate the peripheral portion from about 75 microns to about 300 microns.

13. The fuel injector of claim 12, wherein the passage of the seat comprises first, second, third and fourth wall surfaces extending along the longitudinal axis, the first wall surface extending oblique to the longitudinal axis to define a seating surface convergent towards the outlet, the second wall surface extending generally parallel to the longitudinal axis from the first surface to define a seat orifice, the third wall surface extending oblique to the longitudinal axis from the second wall surface to define an outlet surface diverging towards the outlet, and the fourth wall surface extending generally parallel along the longitudinal axis from the third wall surface.

14. A method of controlling a spray angle of fuel flow through at least one metering orifice of a fuel injector, the fuel injector having an inlet and an outlet and a passage extending along a longitudinal axis therethrough, the outlet having a seat and a metering disc, the metering disc having peripheral, central, and intermediate portions, the peripheral portion extending parallel to a base plane, and the base plane being generally orthogonal with respect to the longitudinal axis, the intermediate portion disposed radially with respect to the longitudinal axis between the peripheral and central portions, the method comprising:

locating a plurality of metering orifices at least onto intermediate portion about the longitudinal-axis-such that the metering-orifices extend generally parallel to the longitudinal axis through the metering disc to define respective generally parallel metering axes; and deforming at least one of the intermediate and central portions of the metering disc so that each of the metering axes extend along a respective orifice axis at a first angle relative to a radial axis from the longitudinal axis through the metering orifice axis, and at a second angle relative to the longitudinal axis.

15. The method of claim 14, wherein the deforming comprises permanently elongating an area of the central portion so that first angle includes an angle from about zero to about 5 degrees.

16. The method of claim 15, wherein the deforming comprises permanently elongating the area of the central portion so that the second angle includes an angle from about 5 degrees to about 10 degrees.

17. The method of claim 16, wherein the locating of plurality of metering orifices comprises punching through the metering disc so that at least two metering orifices are diametrically disposed on a virtual perimeter extending through the respective orifice axes.

18. The method of claim 17, wherein the respective axes of the at least two metering orifices are symmetrical about the longitudinal axis and the radial axis.

19. The method of claim 18, wherein the plurality of metering orifices includes at least four metering orifices disposed equiangularly on the virtual perimeter.

20. The method of claim 16, wherein deforming comprises permanently elongating the central portion of the metering disc so that a curved surface having a radiused apex contiguous to the base plane proximate the inlet.

21. The method of claim 20, wherein the elongating of the area comprises forming at least one planar surfaces intersecting the central portion to define a respective apex projecting towards the outlet.

* * * * *